US008434967B2

(12) United States Patent
Nero

(10) Patent No.: US 8,434,967 B2
(45) Date of Patent: May 7, 2013

(54) WATER SHIELDING BARRIER

(75) Inventor: Ingvar Nero, Mansarp (SE)

(73) Assignee: Inero AB, Mansarp (SE)

( * ) Notice: Subject to any disclaimer, the term of this patent is extended or adjusted under 35 U.S.C. 154(b) by 266 days.

(21) Appl. No.: 12/918,613

(22) PCT Filed: Feb. 5, 2009

(86) PCT No.: PCT/EP2009/000798

§ 371 (c)(1),
(2), (4) Date: Aug. 20, 2010

(87) PCT Pub. No.: WO2009/103429

PCT Pub. Date: Aug. 27, 2009

(65) Prior Publication Data

US 2010/0329785 A1 Dec. 30, 2010

(30) Foreign Application Priority Data

Feb. 22, 2008 (SE) ..... 0800417

(51) Int. Cl.
*E02B 3/10* (2006.01)

(52) U.S. Cl.
USPC ..... 405/107; 405/114; 29/505

(58) Field of Classification Search ..... 405/107, 405/109, 114, 116, 117, 118; 29/505, 509, 29/513
See application file for complete search history.

(56) References Cited

U.S. PATENT DOCUMENTS

| | | | | |
|---|---|---|---|---|
| 6,059,491 | A * | 5/2000 | Striefel et al. | 405/111 |
| 6,079,904 | A * | 6/2000 | Trisl | 405/107 |
| 6,692,188 | B1 * | 2/2004 | Walker et al. | 405/115 |
| 6,840,711 | B1 | 1/2005 | Martinez et al. | |
| 2003/0035690 | A1 | 2/2003 | Earl | |

FOREIGN PATENT DOCUMENTS

| | | | |
|---|---|---|---|
| DE | 200 16 969 | U1 | 4/2001 |
| EP | 1 262 602 | A2 | 5/2002 |
| GB | 17725 | A | 0/1910 |
| SE | 9502817 | C2 | 2/1997 |
| WO | 2006/062393 | A2 | 6/2006 |

OTHER PUBLICATIONS

International Search Report dated Jun. 5, 2009 in corresponding international patent application No. PCT/EP2009/000798, 2 pages.

* cited by examiner

*Primary Examiner* — David Bagnell
*Assistant Examiner* — Benjamin Fiorello
(74) *Attorney, Agent, or Firm* — Maier & Maier PLLC

(57) ABSTRACT

A protective module for use as a water shielding part of a barrier, said barrier being adapted to be positioned between a body of water and an area of land to be protected. The protective module has a main plane and a first, second, third and fourth side, which sides define a main surface of the protective module, in the main plane of the protective module, the first and second sides being arranged opposite each other. A method of manufacturing a protective module according to the invention, concerning a barrier made up of interconnected protective modules and a barrier system including two or more protective modules, the protective modules being adapted to be joined together in such a manner as to form a barrier.

15 Claims, 6 Drawing Sheets

WATER SHIELDING BARRIER

RELATED APPLICATIONS

This is the U.S. national stage application to International Patent Application No.: PCT/EP2009/000798, filed on Feb. 5, 2009, which claims priority under 35 U.S.C. §119 to Swedish Patent Application No.: 0800417-8, filed Feb. 22, 2008, the disclosures of which are incorporated by reference herein in their entireties.

TECHNICAL FIELD

The present invention relates to a protective module for use as a water shielding part of a barrier, said barrier being adapted to be positioned between a body of water and an area of land to be protected.

The protective module has a main plane and a first, second, third and fourth side, which sides define a main surface of the protective module, in the plane of the module, the first and second sides being arranged opposite each other.

The protective module further has at least one first connecting element on the first side and at least one second connecting element on the second side, the first and second connecting elements being complementary to each other, the first connecting element being arranged to be connected to a corresponding second connecting element of another corresponding protective module and the second connecting element being arranged to be connected to a corresponding first connecting element of yet another corresponding protective module.

The invention further relates to a method of manufacturing a protective module according to the invention, a barrier made up of interconnected protective modules according to the invention and a barrier system comprising two or more protective modules according to the invention.

BACKGROUND ART

When assembling protective modules for forming a water protection barrier, for example in flooded areas, it is essential that the assembly work can be carried out swiftly and smoothly in order to minimize the damage that the water may cause. It is also important that the barrier, besides allowing rapid assembly, is robust and impact resistant.

Swedish patent no. 9502817 discloses a barrier made up of conventional loading pallets, which are made to lean against braces for forming of a barrier. A tarpaulin is draped over the loading pallets to make the barrier watertight. The tarpaulin extends a certain distance in front of the barrier and is attached to the loading pallets by means of, for instance, clips or nails and is anchored, for instance, with the aid of sandbags arranged on top of the portion of the tarpaulin that is located in front of the barrier. A drawback of the solution according to SE 9502817 is that the barrier is made up of many different parts, which means that the assembly work includes quite a number of different time-consuming operations. The pallets forming part of the barrier are arranged so as to lean by themselves against the braces.

EP 1 262 602 discloses a barrier made up of panels that are supported in a raised position by a supporting frame to which the panels are attached by snapping. A foil is stretched over several panels in such a manner that the whole surface of the panels is covered, whereby the interspaces between the panels are sealed. A drawback of the solution described in EP 1 262 602 is that a plurality of separate parts are needed to form a complete barrier, which results in a relatively expensive solution and a relatively unwieldy barrier. The panels are held together by means of the supporting frame.

U.S. Pat. No. 6,840,711 discloses a barrier comprising panels and braces. Each panel is provided with a slot for insertion of a joining strip. A drawback of this solution is that it involves several constituent parts and that it can only be extended horizontally. The panels are held in place by means of two holes formed in one panel and two plugs arranged in a corresponding panel, which makes it easy to separate the panels.

Compared with currently available alternatives, there is a need for a protective module which is designed such that a barrier can be rapidly, smoothly and safely formed when assembling two or more protective modules of this kind.

SUMMARY OF THE INVENTION

For the purpose of solving the above problems a protective module is provided and which is characterised in that the protective module is arranged to be brought from an insertion position, wherein the first connecting element of the protective module is in contact with the second connecting element of a corresponding protective module, into a locking position, wherein the first connecting element of the protective module is locked to the second connecting element of a corresponding protective module, in such a way that the main plane of the protective module changes direction in proportion to a main plane of the corresponding protective module when the protective module is brought from the insertion position into the locking position.

According to the invention, as defined by said claim, a protective module is obtained which can be safely and rapidly mounted and which forms a robust and impact resistant barrier when joining together two or more protective modules, since the connecting elements and, thus, the protective modules are locked together.

By turning the protective module from an insertion position into a locking position in such a way that the main plane of the protective module changes direction in proportion to the main plane of a corresponding protective module to which the protective module shall be attached a strong locking is achieved between the modules. It is not possible to pull them apart, the last attached module has to be turned out of the locking position back into the insertion position and then the modules can be pulled apart.

Embodiments of the invention will be apparent from the dependent claims and from the following description and the appended drawings.

By the insertion part and the locking part being arranged to be moved from a first, insertion position, in which the insertion parts are in contact with one another, to a second, locking position, in which the locking parts are in contact with one another and in which the protective module and another corresponding protective module are locked together in a first direction of extension, safe and rapid mounting and flexible locking are obtained. As a result, the barrier may be given, for example, a curved shape while maintaining the protective modules in an interlocked state. Furthermore, the locking of the protective modules is such that it produces an impact resistant barrier that withstands sabotage.

By providing the protective module with a downwardly bent portion that is substantially perpendicular to the main plane of the module, the protective module becomes strong, since the downwardly bent portion acts as a self-supporting girder for the protective module.

By arranging an insertion part for a connecting element at the angle section v between the main plane of the protective module and the downwardly bent portion, the mounting procedure is simplified, since the downwardly bent portion reinforces the protective module and acts as a guide when the connecting elements are being joined together.

The connection between two corresponding protective modules is simplified even further by the connecting elements being slots and protruding portions. The insertion part of the slot and the insertion part of the protruding portion have first dimensions that are complementary to one another, and the locking part of the slot and the locking part of the protruding portion have second dimensions that are complementary to one another. A result of this design of the connecting element is that the transition from the insertion position to the locking position is very quick and smooth, since the parts are already located in the insertion position.

By the protruding part being a cut-out portion of the protective module and the slot being a hole cut in the module, and by the module and the connecting elements being formed in one piece, a simpler and more efficient manufacturing process is obtained. In addition, this method does not require any fixing parts to be subsequently attached to the protective module and reduces the amount of material needed for the protective module.

By arranging an additional downwardly bent portion on the third side of the protective module, adjacent to the downwardly bent portion on the second side, an even more stable protective module is obtained, which facilitates handling and mounting.

By the downwardly bent portion being arranged to receive an adjustable support, which is adapted to hold the plate in a raised position for forming an angle of less than 90° between the main plane of the plate and the ground, it is possible to angle the protective module and, thereby, the barrier according to the ground surface and the needs.

By arranging at least one connecting element on either of the module's sides, it is possible to connect the protective module to another corresponding protective module also in a second direction of extension (y), whereby the barrier is erected both vertically and horizontally.

By arranging a plurality of connecting elements along a substantial part of all sides of the protective module, the assembly and locking are made even more reliable and ensure, owing to the design, a solid but flexible connection between the protective modules.

By arranging a sealing membrane on the protective module, adjacent to the edge portion of two of the four sides of the plate, such that the sealing membrane covers the connecting elements on these sides and extends therefrom outward from the main surface of the plate to form a skirt portion around the protective module on said two sides, a seal is obtained between two or more protective modules according to the invention as well as between the modules and the ground. Because the sealing membrane is mounted in connection with the manufacture of the protective module, no additional operation is required to provide a seal when assembling the barrier. Since the sealing membrane is required at the edge portion of the protective module only, the consumption of material is reduced as are the costs.

Through the invention a protective module is obtained in which the connecting elements consist of slots and protruding portions, said slots on the protective module being arranged, when connecting another corresponding protective module, to engage protruding portions on the corresponding protective module, said slots and protruding portions enabling a smooth assembly and reliable and flexible locking.

Advantageously, the protective module may be a plate, and preferably an aluminium plate.

For the purpose of solving the above problem, the invention further suggests a method of manufacturing a protective module of the kind stated in the preamble of claim 1, which method is characterised by the steps of

- cutting a plate having a main plane and a first, second, third and fourth side, which sides define a main surface of the plate in the main plane of the plate,
- cutting out protruding portions on the first and fourth sides of the plate,
- cutting out slots on the second and third sides of the plate,
- bending the second and third sides of the plate downward for forming a downwardly bent portion that is substantially perpendicular to the main plane of the plate.

By carrying out the method described above a robust and resistant protective module is obtained, which may be connected to corresponding protective modules both vertically and horizontally.

A method is suggested that further comprises the step of

- mounting a sealing membrane adjacent to the edge portion of two of the four sides of the plate, such that the sealing membrane covers the connecting elements on these sides and extends therefrom outward from the main surface of the plate to form a skirt portion around the protective module. By carrying out the method described above a complete protective module having an integrated sealing membrane is obtained already in connection with manufacture. This allows a very smooth and, thus, time-saving assembly of a plurality of protective modules as described above for forming a barrier.

The invention also concerns a barrier made up of interconnected protective modules according to the invention and a barrier system comprising two or more protective modules according to the invention as well as two or more supports.

BRIEF DESCRIPTION OF THE DRAWINGS

The invention will be described in more detail below with reference to the accompanying drawings.

FIG. 2*a* is a perspective view schematically illustrating how two protective modules are to be joined together.

FIG. 2*b* is a perspective view, in enlarged detail, schematically illustrating how a first set of connecting elements are to be inserted in a second set of connecting elements.

FIG. 2*c* is a perspective view, in enlarged detail, schematically illustrating how the connecting elements are moved from a first, insertion position.

FIG. 2*d* is a perspective view schematically illustrating how the connecting elements and, thus, the protective modules are moved to a second, locking position.

FIG. 2*e* is a perspective view, in enlarged detail, schematically illustrating the locking position of the protective modules.

DESCRIPTION OF A PREFERRED EMBODIMENT

Figure 1:
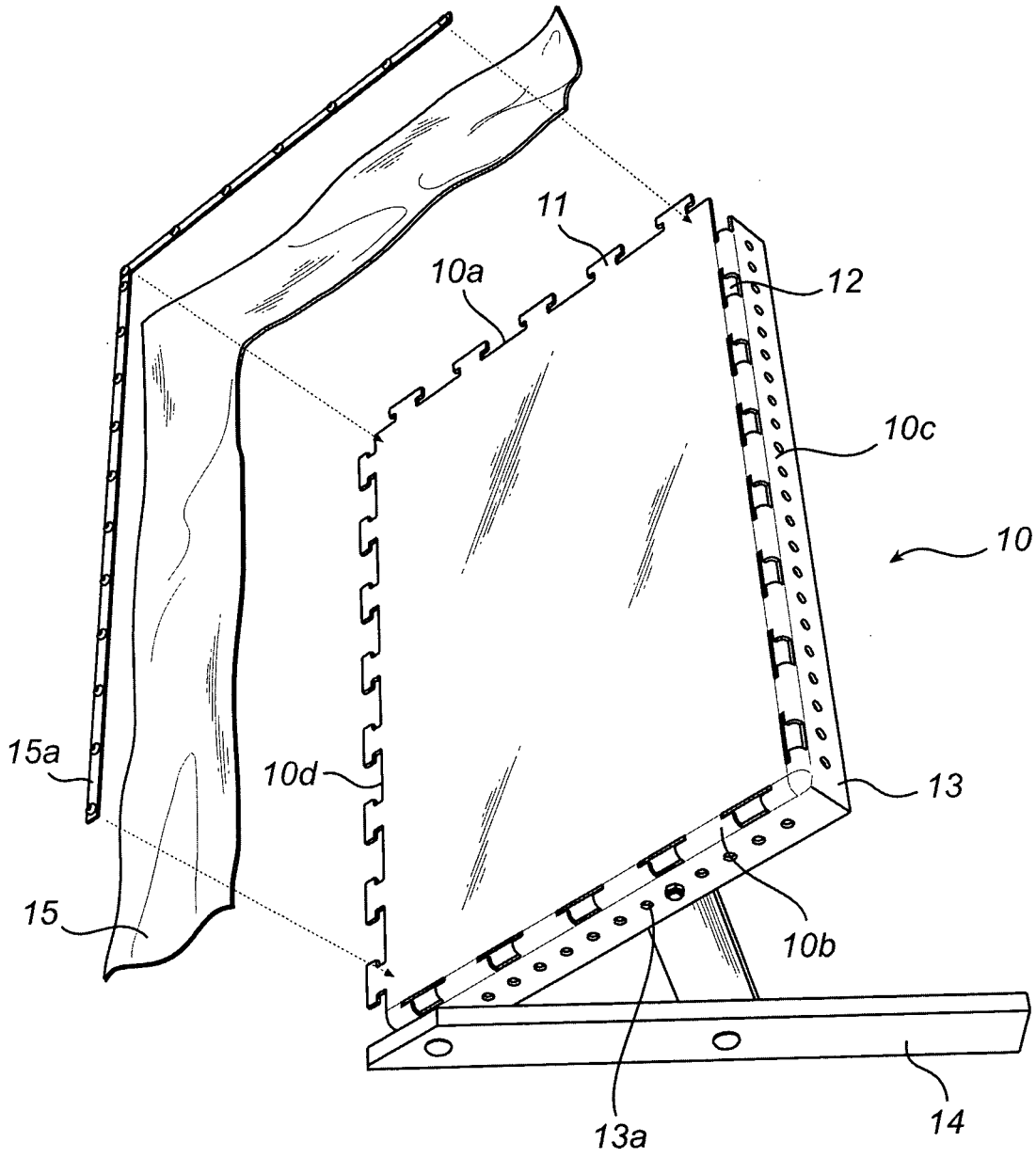
FIG. 1 is a perspective view, and partly an exploded view, schematically illustrating a protective module according to one embodiment of the invention.

The drawings illustrate a protective module 10 according to the present invention, for use as a water shielding part of a flood barrier 50. The flood barrier 50 is adapted to be positioned between a body of water and an area of land to be protected. The flood barrier 50 is made up of two or more protective modules 10. In the following description, reference will also be made to a second protective module 20, a third protective module 30 and a fourth protective module 40, which are all constructed in the same way, thereby corresponding to the protective module 10.

The flood barrier 50 may also be used for other purposes, for example for erecting temporary basins and for draining areas of shallow water.

The basis of the following description is a protective module 10, see FIG. 1, which has a main plane and a first 10*a*, second 10*b*, third 10*c* and fourth 10*d* side, which sides 10*a*, 10*b*, 10*c* and 10*d* define a main surface of the protective module 10, in the main plane of the module. The first 10*a* and the second 10*b* sides are located opposite one another. The third 10*c* and the fourth 10*d* sides are located opposite one another.

Preferably, the protective module 10 is substantially rectangular, having two long sides 10*c*, 10*d* and two short sides 10*a*, 10*b*. The protective module 10 may also have other suitable shapes, for instance a square shape.

Advantageously, the protective module 10 is a plate, preferably of aluminium. The protective module 10 may also be made from other appropriate materials, such as metals, various composite materials and rigid plastic.

The protective module 10 has on its second 10*b* and third 10*c* sides a downwardly bent portion 13, which is bent downwards in such a manner that the portion 13 is substantially perpendicular to the main plane of the protective module 10 and that an angle v is formed between the downwardly bent portion 13 and the main plane of the protective module 10. In another conceivable embodiment of the invention, at least one side may have a downwardly bent portion 13. Alternatively, all sides 10*a*-10*d* may have a downwardly bent portion 13. Alternatively, the protective module 10 is entirely without any downwardly bent portions 13.

The protective module 10 has on its first 10*a* and fourth 10*d* sides at least one first connecting element 11 and on its second 10*b* and third 10*c* sides at least one second connecting element 12, for allowing assembly of two or more corresponding protective modules 10.

The first type of connecting element 11 consists of protruding portions and the second type of connecting element 12 consists of slots. The protruding portions 11 are cut out from the protective module/plate 10 so as to protrude from the main surface of the protective module 10 in line with the main plane of the protective module 10. The slots 12 consist of holes cut in the protective module/plate 10, whereby the slots 12 form through holes that are substantially perpendicular to the main surface of the protective module. When bending the downwardly bent portion 13 downwards, the slot is positioned at the angle section v between the main plane of the protective module 10 and the downwardly bent portion 13. Advantageously, the connecting elements 11, 12 are cut in one piece, including all hole patterns, using watercutting. The connecting elements 11, 12 may also be punched out from the plate/protective module 10 or formed using any other suitable method/technology.

On the first side 10*a*, five protruding portions 11 have been cut out. On the opposite side 10*b*, five slots 12 have been cut. On the third 10*c* side, eight slots 12 have been cut. On the fourth 10*a* side, eight protruding portions 11 have been cut out. The number of protruding portions 11 and slots 12 on each side may be varied according to the needs and design. The protruding portions 11 and the slots 12 are complementary to each other. "Complementary" here means that they complement each other, fit together and are adapted to cooperate. Accordingly, the protruding portions 11 are arranged, when connecting another corresponding protective module, to engage slots 12 on another corresponding protective module.

Figure 2A:
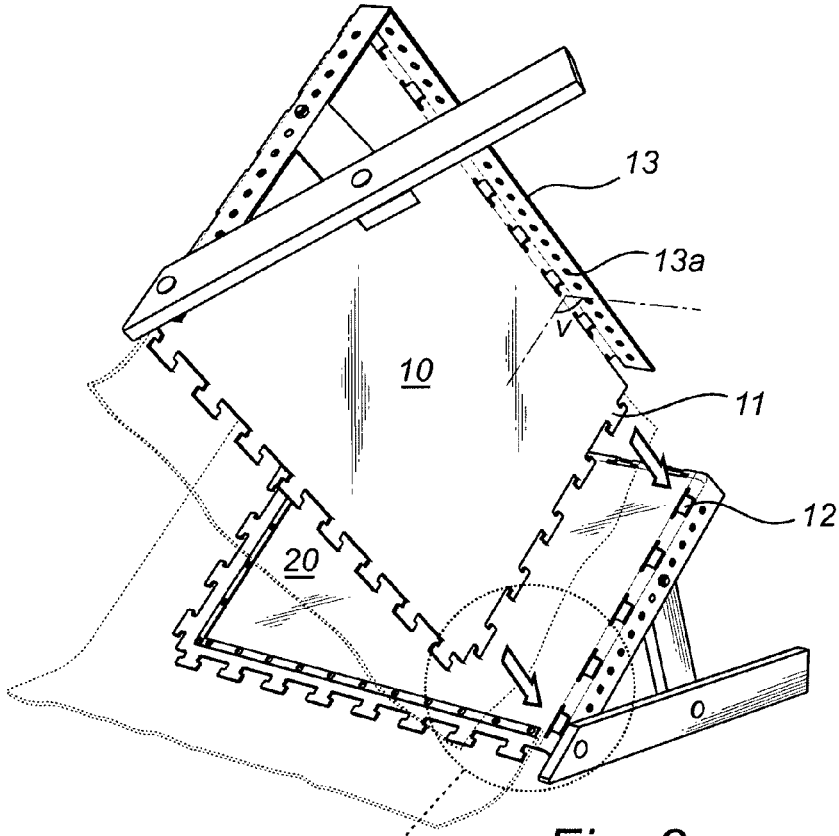
FIGS. 2*a*-2*e* schematically illustrate how the connecting elements of the protective module cooperate when joining together two protective modules.
Figure 2B:
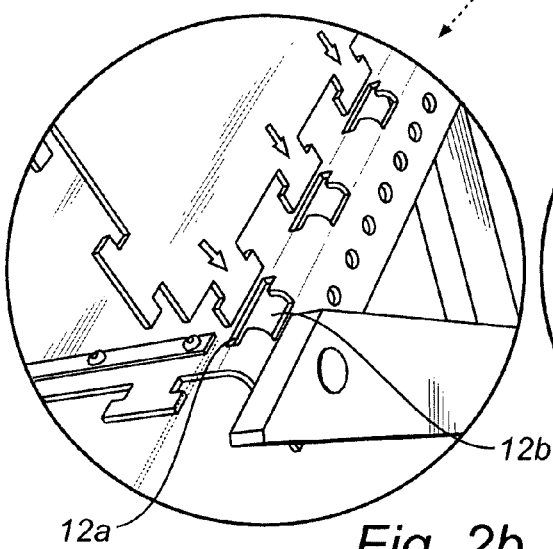
Figure 2C:
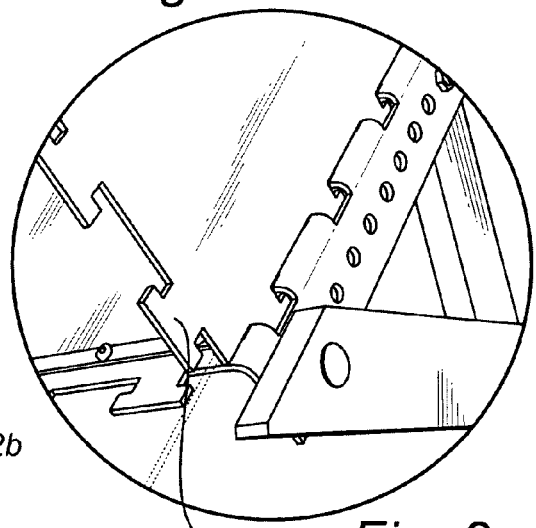
Figure 2D:
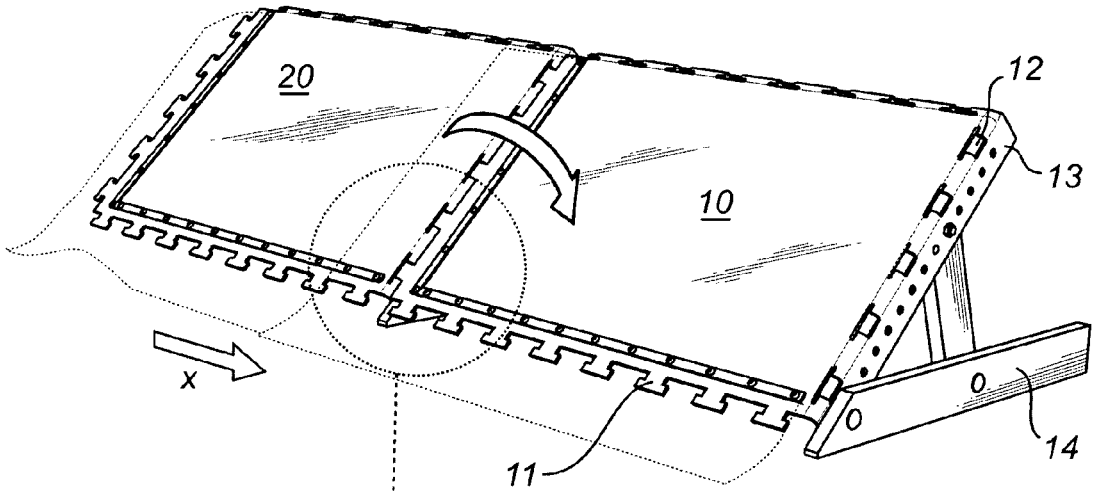
Figure 2E:
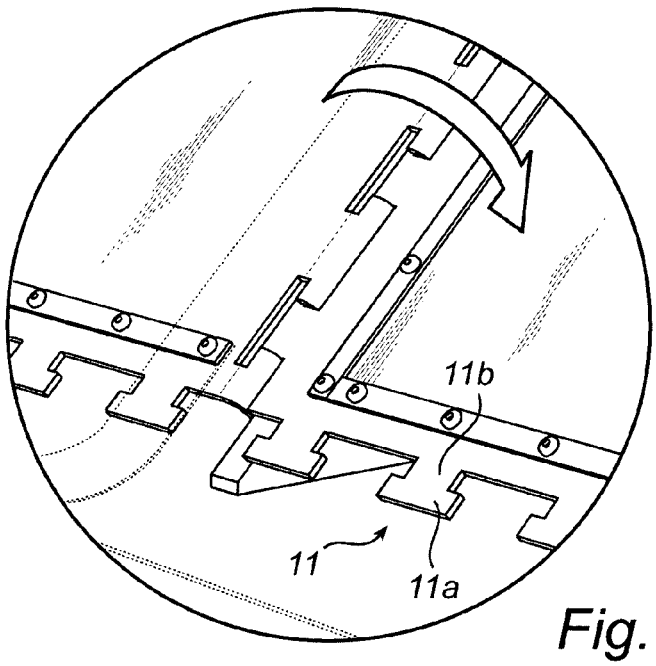

Each connecting element 11, 12 has an insertion part 11*a*, 12*a* and a locking part 11*b*, 12*b*, see FIGS. 2*b* and 2*e*. The parts are arranged such that when the connecting elements 11, 12 are joined together, the protective module 10 is locked to a corresponding protective module. The insertion part 12*a* of the slot 12 and the insertion part 11*a* of the protruding portion 11 have first dimensions that are mutually compatible. "Compatible" here means that the dimensions match. The locking part 12*b* of the slot 12 and the locking part 11*b* of the protruding portion 11 have second dimensions that are mutually compatible. The size and shape of the different constituent parts 11*a*, 11*b*, 12*a*, 12*b* may be varied according to needs and desires.

Furthermore, the protective module 10 is provided with a sealing membrane 15. Preferably, the sealing membrane 15 is made of a basin sheet material, but other waterproof and water resistant materials that are suitable for the purpose may also be used, for example canvas, tarpaulin and impregnated materials. The sealing membrane 15 is arranged on the protective module 10, adjacent to the edge portion of two 10*a*, 10*d* of the four sides 10*a*-10*d* of the protective module 10, such that the sealing membrane 15 covers the connecting elements, the protruding portions 11, on these sides 10*a*, 10*d*, and extends therefrom outward from the main surface of the protective module 10 to form a skirt portion around the protective module 10 on said two sides 10*a*, 10*d*, see for example FIGS. 2*d* and 3. The sealing membrane 15 is attached to the protective module 10 by means of some kind of attaching means 15*a*, for instance a fixing rail, which is bolted screwed, welded or attached in any other suitable manner to the protective module 10, see FIG. 1.

Figure 6:
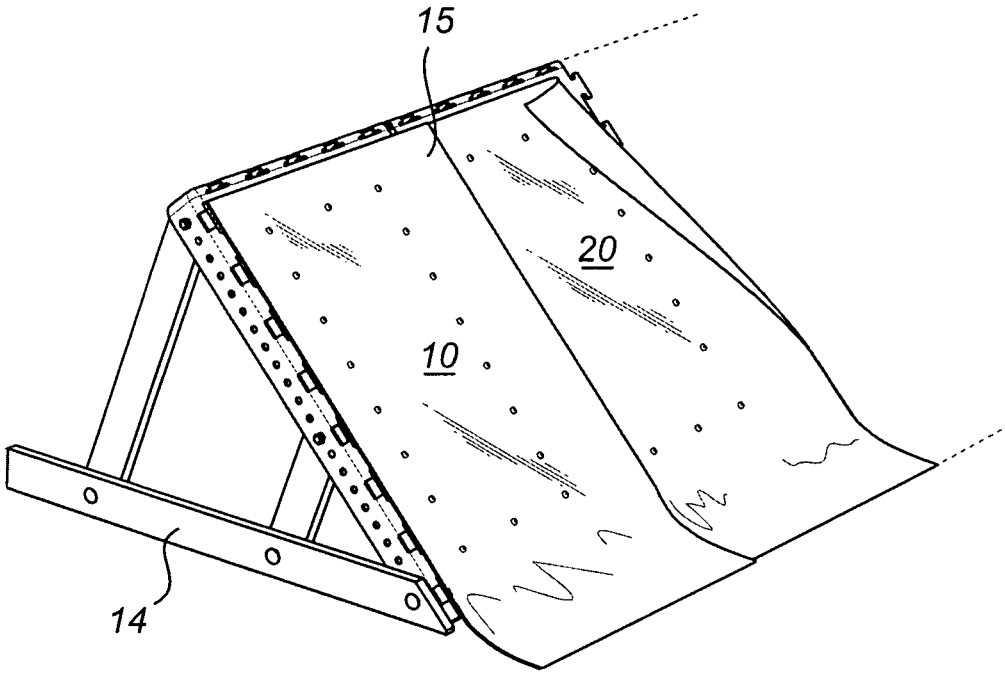

In one embodiment of the invention the sealing membrane 15 covers not only the connecting elements, but the total surface of the protective module 10, see FIG. 6. The sealing membrane 15 is attached to the protective module 10 by means of some kind of attaching means 15*a*, as described above, in such a way that the protective module 10 and the sealing membrane 15 are one connected unit.

The protective module 10 is arranged to receive, at the downwardly bent portion 13, an adjustable support 14, said support 14 being adapted to support the protective module 10 in a raised position for forming an angle of less than 90° between the main plane of the protective module 10 and the ground. The supports 14 may be made of, for example, wood or metal, and advantageously of aluminium. The support 14 is secured, for example by means of screws, bolts or the like, in pre-cut holes 13*a* on the downwardly bent side 13 against which the protective module 10 is resting. Owing to the downwardly bent portion 14 and the angle v, the protective module 10 may be arranged to rest only against the support without being secured by means of the holes 13*a*. In the place of a support 14, the protective modules 10 may also lean against existing buildings, walls, road guide rails, embankments or sandbags or the like. The protective modules may be arranged with the side 10*d* resting on the ground, but may also be arranged edgeways, for instance with the side 10*a* resting on the ground.

Figure 7:
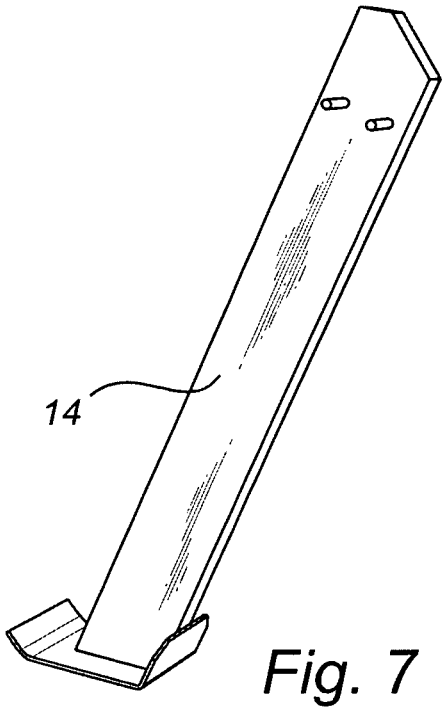
FIG. 7 is a perspective view schematically illustrating a barrier system, in which a support according to another embodiment of the invention is shown.

In FIG. 1-6 one type of support is shown. In FIG. 7 a support 14 according to another embodiment of the invention is shown.

When manufacturing a protective module 10 according to the invention, the general method outlined below is followed, said method comprising the steps of

- cutting a plate having a main plane and a first 10*a*, second 10*b*, third 10*c* and fourth 10*d* side, which sides define a main surface of the plate in the main plane of the plate,
- cutting out protruding portions on the first 10*a* and fourth 10*d* sides of the plate,
- cutting out slots on the second 10*b* and third 10*c* sides of the plate,
- bending the second 10*b* and third 10*c* sides of the plate downward for forming a portion 13, which is substantially perpendicular to the main plane of the plate 10, such that the insertion part 12*a* and the locking part 12*b* of the slots 12 are situated on either side of the angle v.

In one embodiment of the invention, the method further comprises the step of

- attaching, with the aid of a fixing rail 15*a*, or in any other manner suitable for the purpose, a sealing membrane 15 on the first 10*a* and fourth 10*d* sides of the protective module 10, such that the sealing membrane forms an integrated part of the plate.

FIGS. 2*a*-2*e* show how two corresponding protective modules 10 and 20 joined together.

The protective module 10 is arranged to be brought from an insertion position, see FIG. 2*a*-2*c* into a locking position 2*d*-2*e* with the corresponding protective module 20. The protective module 10 is arranged to be brought from an insertion position, wherein the first connecting element 11 of the protective module 10 is in contact with the second connecting element 12 of a corresponding protective module 20, 30, into a locking position, wherein the first connecting element 11 of the protective module 10 is locked to the second connecting element 12 of a corresponding protective module 20, 30, in such a way that the main plane of the protective module 10 changes direction in proportion to a main plane of the corresponding protective module 20, 30 when the protective module 10 is brought from the insertion position into the locking position. When the protective modules 10, 20 are in the locking position the main planes of the modules 10, 20 are substantially horizontally arranged to each other, see FIG. 2*d*.

FIG. 2*a* shows how the second protective module 20 is arranged on the ground and held in position, here by means of the support 14. The first protective module 10 is angled so that the main planes of the two protective modules 10, 20 are substantially perpendicular to one another and so that the protruding portions 11 of the first protective module 10 are substantially perpendicular to the slots 12 of the second protective module 20. FIG. 2*b* shows how the insertion parts 11*a* of the first protective module 10 are moved substantially perpendicularly towards the insertion parts 12*a* of the second protective module 20. FIG. 2*c* show the insertion parts 11*a*, 11*b* in contact with each other in an insertion position. FIGS. 2*d* and 2*e* show how the first protective module 10 is turned down so that its main plane is substantially horizontal with the main plane of the protective module 20, the locking parts 11*b*, 12*b* being in contact with each other in a locking position. Accordingly, the locking parts 11*b*, 12*b* are designed such that, when the insertion part 11*a* of the protruding portion 11 is inserted in the insertion part 12*a* of a corresponding slot 12 of another corresponding protective module, the connecting elements 11, 12 are moved from an insertion position, in which the insertion parts 11*a*, 12*a* are in contact with each other, to a locking position, in which the locking parts 11*b*, 12*b* are in contact with each other and in which the protective module 10 and another corresponding protective module are locked together in a first direction of extension x.

Figure 3:
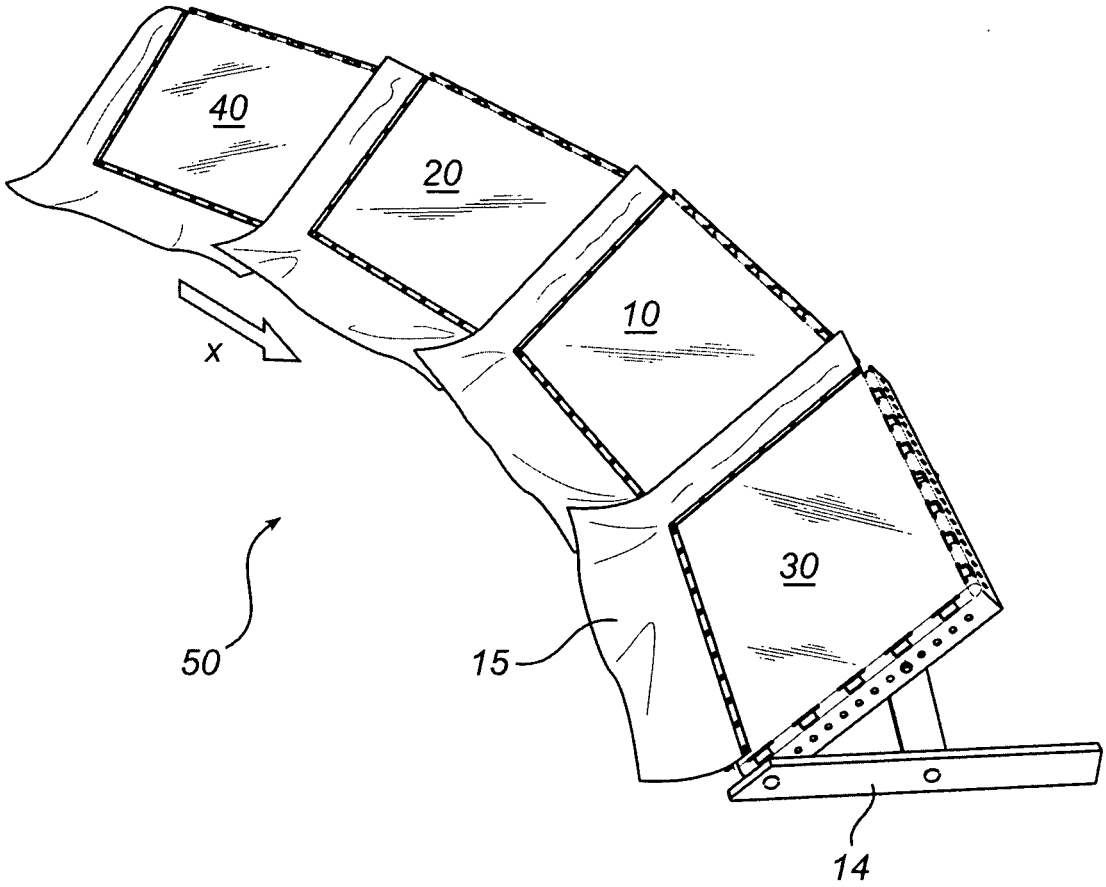
FIG. 3 is a perspective view schematically illustrating a barrier system, in which a plurality of protective modules according to the invention are interconnected to form a barrier in a first direction of extension.
Figure 4:
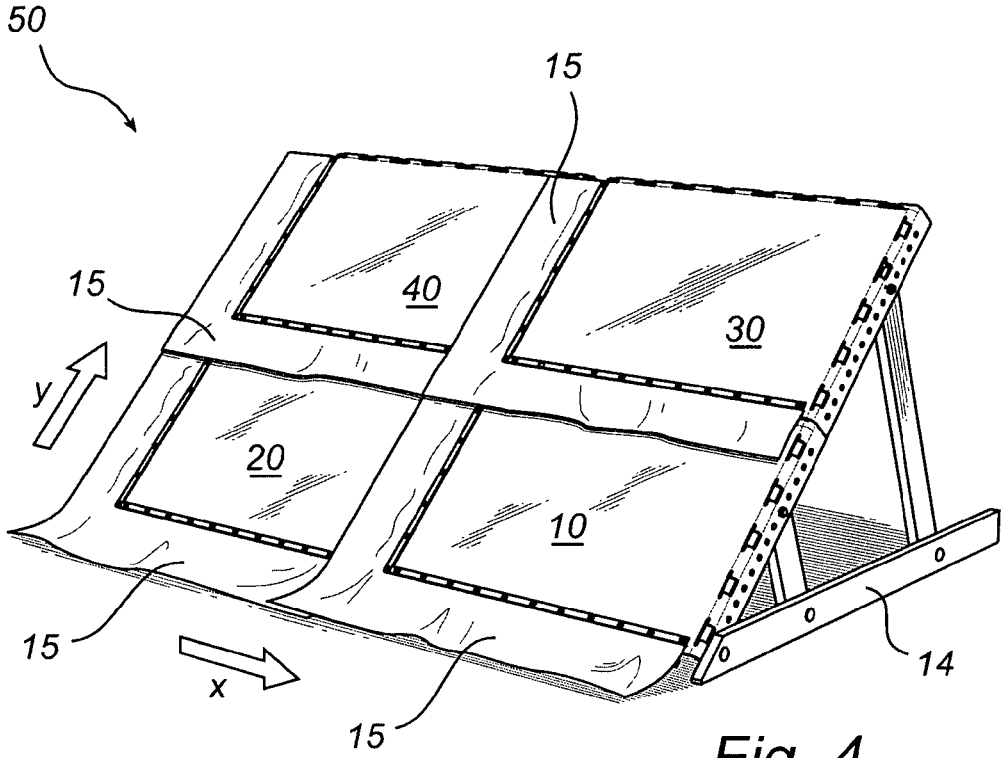
FIG. 4 is a perspective view schematically illustrating a barrier system, in which a plurality of protective modules according to the invention are interconnected to form a barrier in a first and a second direction of extension.
Figure 5:
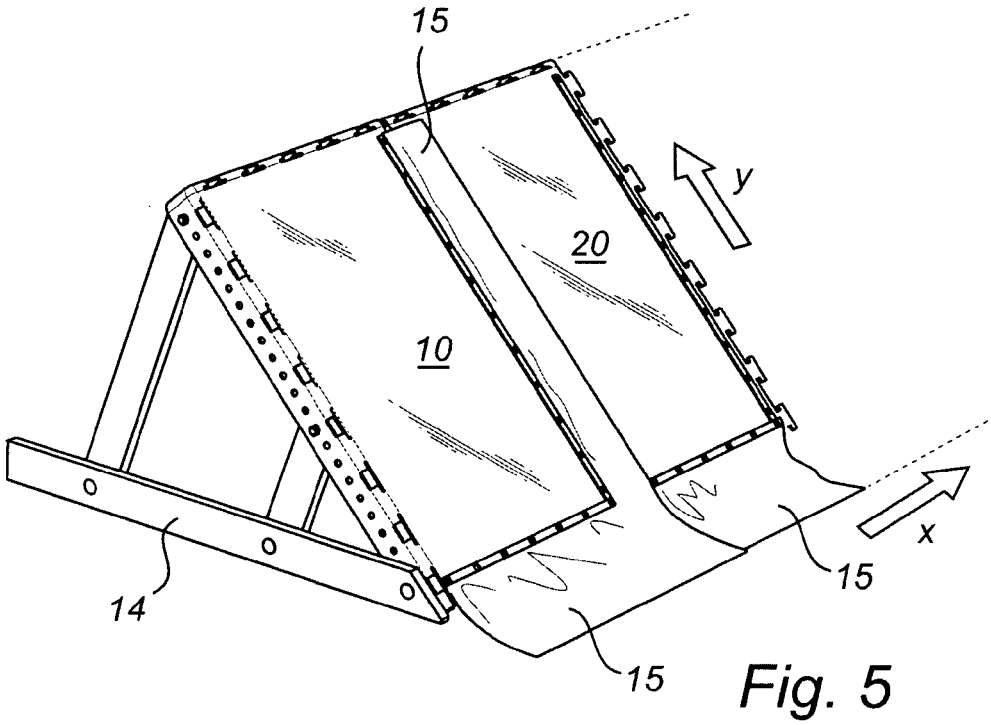
FIG. 5 is a perspective view schematically illustrating a barrier system, in which two protective modules are arranged in a standing position and interconnected to form a barrier in a first direction of extension, and wherein the FIG. 6 is a perspective view schematically illustrating a barrier system, in which the protective modules are arranged with a sealing membrane according to one embodiment of the invention.

Protruding portions 11 are arranged on the first 10*a* and fourth 10*d* sides of the protective module 10, and slots 12 are arranged on the second 10*b* and third 10*c* sides of the protective module 10, so as to allow joining of the protective module 10 with another corresponding protective module also in a second direction of extension y. FIG. 3 shows how four corresponding protective modules 10, 20, 30, 40 are arranged in the first direction of extension x for forming a barrier 50. FIG. 3 also shows that the protective modules are locked together in a flexible manner, which allows forming a substantially arc-shaped barrier 50. FIG. 4 shows how four protective modules 10, 20, 30, 40 are interconnected in both the first x and the second y direction of extension for forming a barrier 50.

FIGS. 3-4 further shows how the sealing membrane 15 on each protective module 10-40 covers the connections between the protective modules and that the sealing membrane 15 extends a certain distance in front of the barrier 50 and seals against the ground, which affords a watertight barrier 50.

The protruding portions 11 on the fourth 10*d* side are arranged to bear against the ground or surface on which the barrier 50 is to be erected. The slots 12 on the third 10*c* side are arranged to receive protruding portions 11 from a fourth 10*d* side of yet another corresponding protective module 30.

As mentioned previously, the protective modules 10-40 may be arranged edgeways, for instance such that the first side 10*a* rests on the ground.

The invention further relates to a barrier 50 made up of two or more protective modules 10 and a barrier system comprising two or more protective modules. In one embodiment of the invention, the barrier system also comprises two or more supports 14.

Since the protective module 10 is provided on a short side 10*b* and a long side 10*c* thereof with a slot 12 acting as a connecting element and being formed when the plate is bent and the protective module 10 is provided on the corresponding short side 10*a* and long side 10*c* thereof with a cut-out protruding portion 11 acting as a connecting element, the protective modules 10-40 may be interconnected, one slot 12 to one protruding portion 11, vertically (along the y-axis) and/or horizontally (along the x-axis), thus allowing an infinite amount to be arranged vertically and horizontally.

The sealing membrane 15 seals between the protective modules 10-40 and the ground/underlying surface. The protective modules may be joined together at their connection elements 11, 12 in a vertical or horizontal position and may be supported by a support 14 or, alternatively, by existing buildings, walls, road guide rails, sandbags and the like. The protective modules may be substantially vertical to the underlying surface/ground or be tilted at an angle of less than 90°.

The protective modules are interconnected in a standing or lying position depending on the desired height, they follow the differences in height of the ground surface and they may be deflected according to the desired positioning.

A standard SJ/EUR-pallet may be used to store and transport about 100 meters of barrier at a height of about 1.2 meters.

The protective module 10 may be modified in various ways within the scope of the appended claims.

The invention claimed is:

1. A protective module for use as a water shielding part of a barrier, said barrier being adapted to be positioned between a body of water and an area of land to be protected, the protective module comprising:

a main plane and a first, second, third and fourth side, which sides define the main plane of the protective module, the protective module further comprising at least one first connecting element arranged at the first side and at least one second connecting element arranged at the second side, the first connecting element and the second connecting element being complementary to one another, and the first connecting element being arranged to be connected to a corresponding second connecting element of another corresponding protective module, and the second connecting element being arranged to be connected to a corresponding first connecting element of yet another corresponding protective module, wherein the protective module is arranged to be brought from an insertion position, wherein the first connecting element of the protective module is in contact with the second connecting element of a corresponding protective module, into a locking position, wherein the first connecting element of the protective module is locked to the second connecting element of a corresponding protective module, in such a way that the main plane of the protective module changes direction in proportion to a main plane of the corresponding protective module when the protective module is brought from the insertion position into the locking position, wherein each connecting element has an insertion part and a locking part, which parts are arranged to cooperate with the corresponding insertion part and locking part of another corresponding protective module in such a manner that the protective modules are locked together, wherein the protective module on the second side has a downwardly bent portion, said portion being bent downwards in such a manner that the portion is substantially perpendicular to the main plane of the protective module, and wherein at least one connecting element is arranged at an angle between the downwardly bent portion and the main plane of the protective module, such that the insertion part of the connecting element is arranged on the main surface/main plane side of the angle and the locking part of the connecting element is arranged on the downwardly bent portion side of the angle.

2. The protective module according to claim 1, wherein the insertion part and the locking part of the connecting elements are designed such that, when the insertion portion of the first connecting element is inserted in an insertion part of a corresponding second connecting element of another corresponding protective module, the connecting elements are moved from an insertion position, in which the insertion parts are in contact with each other and in which the protective module and the other corresponding protective module are locked together in a first direction of extension.

3. The protective module according to a claim 1, wherein the connecting elements consist of protruding portions and slots, the insertion part of the slot and the insertion part of the protruding portion having first dimensions that are complementary to one another and the locking part of the slot and the locking part of the protruding portion having second dimensions that are complementary to one another.

4. The protective module according to claim 3, wherein the protruding portion consists of a cut-out portion of the protective module, in the main plane of the protective module, and the slot consists of a hole cut in the protective module, at the angular section between the main plane of the protective module and the downwardly bent portion, the protective module and the connecting elements being formed in one piece.

5. The protective module according to claim 1, wherein an additional downwardly bent portion is arranged on the third side of the protective module, adjacent to the downwardly bent portion on the second side.

6. The protective module according to claim 1, wherein the downwardly bent portion is arranged to receive an adjustable support, said support being intended to support the protective module in a raised position for forming an angle of less than 90° between the main plane of the protective module and the ground.

7. The protective module according to claim 1, wherein at least one connecting element is arranged on each of the sides of the module, at least one protruding portion is arranged on the first and fourth sides of the protective module and at least one slot is formed on the second and third sides of the protective module, so as to allow joining of the protective module with another corresponding protective module also in a second direction of extension.

8. The protective module according to claim 1, wherein a plurality of connecting elements are arranged along a substantial part of all sides of the protective module.

9. The protective module according to claim 1, wherein a sealing membrane is arranged on the protective module, adjacent to the edge portion of two of the four sides of the protective module, such that the sealing membrane covers the connecting elements on these sides and extends therefrom outward from the main surface of the protective module to form a skirt portion around the protective module on said two sides.

10. The protective module according to claim 1, wherein the connecting elements consist of slots, said slots being provided on two of the four sides of the protective module, which four sides define a main surface of the protective module, in the main plane of the protective module, and of protruding portions, said protruding portions being arranged on two of the four sides of the protective module and said protruding portions protruding from the main surface of the protective module in line with the main plane of the protective module, and said slots on the protective module being arranged, when connecting another corresponding protective module, to engage protruding portions on the corresponding protective module.

11. The protective module according to claim 1, wherein the protective module is an aluminum plate.

12. A method of manufacturing a protective module, which comprises:

cutting a plate having a main plane and a first, second, third and fourth side, which sides define a main surface of the plate in the main plane of the plate, cutting out protruding portions on the first and fourth sides of the plate, cutting out slots on the second and third sides of the plate, bending the second and third sides of the plate downward for forming a downwardly bent portion that is substantially perpendicular to the main plane of the plate.

13. The method according to claim 12, further comprising:

attaching a sealing membrane adjacent to the edge portion of two of the four sides of the plate, such that the sealing membrane covers the connecting elements on these sides and extends therefrom outward from the main surface of the plate to form a skirt portion around the protective module on said two sides.

14. A barrier system comprising two or more protective modules, wherein the protective modules are adapted to be joined together in such a manner as to form a barrier, said barrier being adapted to be positioned between a body of water and an area of land to be protected, each protective module having a main plane and a first, second, third and fourth side, which sides define the main plane of the protective module, each protective module further having at least one first connecting element on the first side and at least one second connecting element on the second side, the first connecting element and the second connecting element being complementary to each other, and the first connecting element of a first protective module being arranged to be connected to a corresponding connecting element of a second corresponding protective module, and the second connecting element being arranged to be connected to a corresponding first connecting element of a third corresponding protective module, wherein the protective module is arranged to be brought from an insertion position, wherein the first connecting element of the protective module is in contact with the second connecting element of a corresponding protective module, into a locking position, wherein the first connecting element of the protective module is locked to the second connecting element of a corresponding protective module, in such a way that the main plane of the protective module changes direction in proportion to a main plane of the corresponding protective module when the protective module is brought from the insertion position into the locking position, wherein each connecting element has an insertion part and a locking part, which parts are arranged to cooperate with the corresponding insertion part and locking part of another corresponding protective module in such a manner that the protective modules are locked together, wherein the protective module on the second side has a downwardly bent portion, said portion being bent downwards in such a manner that the portion is substantially perpendicular to the main plane of the protective module, and wherein at least one connecting element is arranged at an angle between the downwardly bent portion and the main plane of the protective module, such that the insertion part of the connecting element is arranged on the main surface/main plane side of the angle and the locking part of the connecting element is arranged on the downwardly bent portion side of the angle.

15. The barrier system according to claim 14, which system further comprises two or more supports.

* * * * *